US010171921B2

(12) United States Patent
Pedersen et al.

(10) Patent No.: US 10,171,921 B2
(45) Date of Patent: Jan. 1, 2019

(54) MICROPHONE MATCHING UNIT AND HEARING AID

(71) Applicant: Oticon A/S, Smørum (DK)

(72) Inventors: Michael Syskind Pedersen, Smørum (DK); Jan Thor Lunddahl Larsen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/257,333

(22) Filed: Sep. 6, 2016

(65) Prior Publication Data

US 2017/0070826 A1 Mar. 9, 2017

(30) Foreign Application Priority Data

Sep. 7, 2015 (EP) ..... 15184133

(51) Int. Cl.
*H04R 25/00* (2006.01)
*H04R 29/00* (2006.01)

(52) U.S. Cl.
CPC ..... *H04R 25/407* (2013.01); *H04R 25/30* (2013.01); *H04R 25/405* (2013.01); *H04R 29/006* (2013.01)

(58) Field of Classification Search
None
See application file for complete search history.

(56) References Cited

U.S. PATENT DOCUMENTS

2007/0030990 A1 2/2007 Fischer
2009/0147977 A1* 6/2009 Lamm ..... H04R 25/558 381/315

(Continued)

FOREIGN PATENT DOCUMENTS

EP 1 191 817 A1 3/2002
EP 2 843 971 A1 3/2015
WO WO 2006/042540 A1 4/2006

OTHER PUBLICATIONS

Mingsian R Bai et al. "Chapters 6.8 System Integraton and Experimental Arrangement and 10.2.5 Epilog" in "Acoustic Array Systems", Jul. 3, 2013, John Wiley & Sons Singapore Pte. Ltd., Singapore, XP055432792, ISBN: 978-0-470-82723-9, pp. 281-285 and 497-0498.

*Primary Examiner* — Matthew Eason
(74) *Attorney, Agent, or Firm* — Birch, Stewart, Kolasch & Birch, LLP

(57) ABSTRACT

The invention relates to a method and an apparatus for performing a microphone matching of a hearing aid comprising a first microphone, a second microphone and a receiver in a predetermined spatial arrangement to each other. The method comprises the steps of: generating an output sound signal by means of the receiver; picking up a first and second input sound signal by the first and second microphones while the output sound signal is generated; converting the first and second input sound signals into a first and second electrical microphone output signal by means of the microphones; determining a first and second microphone response of the microphones; determining a microphone response difference between the first microphone response and the second microphone response; determining a matching difference between the microphone response difference and a predetermined reference microphone response difference; and adapting at least a first microphone gain of the first microphone according to the matching difference to reduce the matching difference.

20 Claims, 7 Drawing Sheets

(56) References Cited

U.S. PATENT DOCUMENTS

| | | | | |
|---|---|---|---|---|
| 2010/0272273 | A1 | 10/2010 | Chua et al. | |
| 2011/0013797 | A1* | 1/2011 | Cheng | H04R 25/608 381/324 |
| 2011/0051963 | A1* | 3/2011 | Barthel | H04R 25/70 381/314 |
| 2016/0183012 | A1* | 6/2016 | Pedersen | H04R 25/505 381/315 |

* cited by examiner

MICROPHONE MATCHING UNIT AND HEARING AID

The invention relates to a method for performing a microphone matching of a hearing aid. The invention further relates to a microphone matching unit, to a hearing aid, to a microphone matching arrangement, and to a computer program for controlling a hearing aid.

Hearing aids with multiple microphones are widely used by people who suffer from hearing limitations or hearing loss. Comparing input sound signals of at least two microphones oriented towards two different directions enables the hearing aid to provide a directionality of an output sound signal of a receiver (loudspeaker) of the hearing aid. This can be particularly advantageous for the user of the hearing aid during a conversation with a further person for suppressing surrounded noise.

Document EP 2 843 971 A1 describes a hearing aid with a receiver configured to be arranged in the ear canal. The hearing aid device comprises a directional microphone system comprising two microphones or one microphone having two sound inlets. The hearing aid device further comprises means for counteracting acoustic feedback on the basis of sound signals detected by the two microphones or the two sound inlets. The two microphones or the two sound inlets of the directional microphone, forming part of a directional system, are arranged in the ear canal at the same side of the receiver and sound is allowed to propagate freely between the microphones or between the inlets of the directional microphone and the receiver.

It is an object of the invention to provide an improved directional system of a hearing aid.

According to a first aspect, the invention relates to a method for performing a microphone matching of a hearing aid. The hearing aid comprises a first microphone, a second microphone and a receiver (loudspeaker), in a predetermined spatial arrangement relative to each other. The method comprises the steps

- generating an output sound signal by means of the receiver;
- picking up a first input sound signal by the first microphone and a second input sound signal by the second microphone while the output sound signal is generated;
- converting the first input sound signal into a first electrical microphone output signal by means of the first microphone and the second input sound signal into a second electrical microphone output signal by means of the second microphone;
- determining a first microphone response of the first microphone, and a second microphone response of the second microphone;
- determining a microphone response difference between the first microphone response and the second microphone response (at a given point in time);
- determining a matching difference between the microphone response difference and a predetermined reference microphone response difference (for said hearing aid using said predetermined spatial arrangement, and determined at a reference point in time prior to the given point in time); and
- adapting at least a first microphone gain of the first microphone according to the matching difference to reduce the matching difference between the microphone response difference and the predetermined reference microphone response difference.

The method according to the first aspect of the invention advantageously improves a matching between the first microphone and second microphone by reducing the matching difference between the microphone response difference and the predetermined reference microphone response difference. Such a matching can compensate variations in the microphone production and over time, which otherwise would lead to the first and second microphones not being fully matched, which would result in a degradation of a directional performance. Especially in hearing instruments that contain the first microphone in a behind-the-ear (BTE) part and the second microphone in an in-the-ear (ITE) part, it is not possible to match the microphones during production, as both BTE and ITE parts may be replaced later on.

A further advantage of the method is that it can be directly implemented into a hearing aid, so that no external processing devices and no corresponding repair service by a respective specialist might be needed.

The method according to the first aspect of the invention can be carried out by the user in an advantageously simple manner, e.g. by pushing a respective button, or can even be started automatically by the hearing aid that is arranged in the predetermined spatial arrangement. Furthermore, since the only requirement for carrying out the present method is the predetermined spatial arrangement, the starting and performing of the method for performing a microphone matching is particularly simple and intuitive for a hearing aid user.

The present method has also the advantage that its subsequent steps can be easily implemented to be carried out automatically, so that the method can be advantageously automated.

Preferably, the predetermined reference microphone response difference is determined at a reference point in time, e.g. in advance of use of the hearing aid (or at least in an earlier point in time than the (present) point in time, where the microphone response difference between the first microphone response and the second microphone response is determined according to the method). Preferably, the predetermined reference microphone response difference is determined using the same predetermined spatial arrangement of the first microphone, the second microphone and the receiver (loudspeaker) relative to each other as is used for determining the microphone response difference between the first microphone response and the second microphone response (at the given point in time, which is later than reference point in time).

In an embodiment, the reference microphone response difference is determined as a difference between a first reference microphone response of the first microphone and a second reference microphone response of the second microphone (measured at said reference point in time).

In an embodiment, the first microphone response of the first microphone, and the second microphone response of the second microphone are determined based on the first electrical microphone output signal and the second electrical microphone output signal, respectively.

The adaptation of at least a first microphone gain means a changing of parameters of the first microphone in order to change a transfer function of the first microphone (e.g. its frequency and phase response), which describes a transition of the first input sound signal into the first electrical microphone output signal.

In the following, embodiments of the method according to the first aspect will be described.

In a preferred embodiment, the method according to the first aspect of the invention comprises the steps

- comparing the matching difference with a predetermined difference threshold;

repeating the method for performing a microphone matching according the first aspect of the invention as long as the predetermined difference threshold is smaller than the respective matching difference.

The method of this preferred embodiment adapts the microphone matching of the hearing aid iteratively until the matching difference is smaller or equal to the predetermined difference threshold. Thus, the microphones of the hearing aid can reach a better matching in view of subsequent steps of adapting at least the first microphone. Furthermore, using a predetermined difference threshold has the advantage that a duration of processing of this method can be controlled as desired, by either using a very small predetermined difference threshold, thereby taking into account a long duration of processing, or by using a large predetermined difference threshold and thus shorten the duration of processing. Using the predetermined difference threshold has the further advantages that a quality of the microphone matching can be predetermined and thus unified between hearing aids of the same type, from the same user or from the same manufacturer.

In a further embodiment of the method, the first and second microphone responses comprise an impulse response, a frequency response, an amplitude response, or a phase response of the respective microphone. In a variant of this embodiment, the first and second microphone responses comprise a combination of the impulse response, the frequency response, the amplitude response, or of the phase response of the respective microphone. According to a structure of the hearing aid, it might be simpler to measure the amplitude response or the impulse response than to measure the frequency response, so that the method according to this embodiment is advantageously adapted at the structure of the hearing aid. In a further variant of this embodiment, a user input can be received, which is indicative of a type of microphone response that should be used for carrying out the method, and the microphone response is determined in this variant according to the received user input. In this variant, the user of the hearing aid is allowed to have a stronger influence on the processing of the method.

In another embodiment of the method, the first microphone response is determined from the first electrical microphone output signal and the second microphone response is determined from the second electrical microphone output signal. Thus, in this embodiment, the microphone responses can be simply transmitted by providing an electrical connection between the microphones and a unit that determines the microphone responses for further processing steps. In a variant of this embodiment, the method comprises a wireless transmission of the microphone responses by transmitting a signal that is indicative of the information provided by the first and second electrical microphone output signals. In this variant, an external device is provided for processing steps of the method according to the first aspect of the invention.

In an embodiment of the method, the first microphone response is determined from a first estimate of a first feedback path from the receiver to the first microphone and the second microphone response is determined from a second estimate of a second feedback path from the receiver to the second microphone. In this embodiment, the different feedback paths from the receiver to the first and second microphones are taken into account for determining the respective first and second microphone response. In this embodiment, for comparing the microphone responses by determining the microphone response difference, the microphone responses have to be set in relation to each other according to the predetermined spatial arrangement of the first and second microphones and thus according to the first and second estimates of the respective first and second feedback paths. For this reason, the use of the first and second estimates can improve the determination of the microphone responses. In an embodiment, the feedback path is estimated as an impulse response. In an embodiment, the feedback path is estimated as a frequency response, e.g. comprising values of magnitude and phase at a number of frequencies, covering a frequency range where feedback is expected to occur. In an embodiment, the feedback path is estimated (and thus the microphone responses) based on a probe signal received from the loudspeaker (i.e. measured while a probe signal included in the output sound signal provided by the loudspeaker).

As the microphone matching method not necessarily have to run online in a hearing instrument, the algorithm does not have to be adaptive. The adaptation of at least the first microphone gain comprises, in a further embodiment of the method, a least mean-square (LMS) or a normalized least mean-square (NLMS) algorithm (e.g. an adaptive algorithm), is used according to the matching difference to reduce the matching difference between the microphone response difference and the predetermined reference microphone response difference. The well known LMS and NLMS algorithms of this embodiment have the advantage of computational simplicity, leading to a fast processing of the method. Using the NLMS algorithm has the further advantage compared to the LMS algorithm that a variable step size parameter is used for each iteration step of the algorithm, allowing a faster and more precise processing of the algorithm.

In a further embodiment of the first aspect of the invention, the method further comprises as a first step a provision of a predetermined measuring environment for the hearing aid according to the predetermined reference microphone response difference. Thus, a method according to this embodiment simplifies a provision of the predetermined spatial arrangement, which is required for performing the method. Predetermined measuring environment according to this embodiment means predetermined spatial distances between the receiver and both microphones. In a variant of this embodiment, the predetermined measuring environment further provides predetermined acoustical conditions, as they can be found for instance in a box. In this preferred variant, the predetermined reference microphone response difference is determined with respect to the predetermined acoustical conditions as well as with respect to the predetermined spatial distances. In a further related variant, the first and second microphone responses are determined with respect to the predetermined acoustical conditions as well as with respect to the predetermined spatial distances. In an embodiment, a predetermined measuring environment for the hearing aid comprises the predetermined spatial arrangement of the input and output transducers of the hearing aid relative to each other and a surrounding environment (during measurement). In an embodiment, the predetermined measuring environment comprises a sound attenuating (e.g. anechoic) environment that decreases reflections from surfaces surrounding the hearing aid.

Thus, first and second predetermined reference feedback paths may be determined in the predetermined measuring environment at a reference point in time. At a subsequent (e.g. current) point in time, the first and second feedback paths may be determined in the same predetermined measuring environment. Based thereon a predetermined reference feedback path differences ($\Delta FBP_{REF}$) and a subsequent (e.g. current) feedback path difference ($\Delta FBP_{CURRENT}$) can be determined and compared to provide a matching difference ($\Delta FBP_{CURRENT}-\Delta FBP_{REF}$), which can be minimized (e.g. in a process including comparison to a threshold value) with respect to an applied microphone gain to thereby improve microphone matching, cf. e.g. FIG. 7.

In an embodiment of the method according to the first aspect of the invention, the method further comprises as first steps providing a group of predetermined reference microphone response differences that corresponds to a group of predetermined measuring environments;

receiving a user input indicative of a chosen predetermined measuring environment that is chosen out of the group of predetermined measuring environments;

using a respective predetermined reference microphone response difference out of the group of predetermined reference microphone response differences according to the chosen predetermined measuring environment.

In this embodiment, the user can chose between different predetermined environments, e.g. via a remote control, e.g. implemented in a smartphone or the like. In a variant of this embodiment, the different predetermined environments correspond to different predetermined acoustical conditions, as for instance different boxes. Thus, if the user has a certain box, out of a group of boxes provided by hearing aid manufactures for the microphone matching, the predetermined reference microphone response difference can be adapted according to this box.

In an embodiment, the output sound signal is provided as a specific probe signal. In an embodiment, the probe signal comprises a predefined combination of tones, as for instance pure tones or a predefined sequence of tones at predefined frequencies. In an embodiment, the predefined frequencies are chosen with a view to the frequency range where feedback is expected to occur, for instance above 1.2 kHz.

The determined matching difference between the microphone response difference and the predetermined reference microphone response difference is in one embodiment determined as a sum or an integral between both differences or a squared difference over a frequency, impulse, amplitude or phase range, depending on the respective frequency response used for the method. In another embodiment, the determined matching difference is a difference between a respective value of the microphone response difference and the corresponding value of the predetermined reference microphone response difference for a specific frequency, impulse, amplitude or phase, depending on the respective frequency response used for the method.

According to a second aspect, the invention relates to a microphone matching unit for performing a microphone matching of a hearing aid, the hearing aid comprises a first microphone, a second microphone and a receiver in a predetermined spatial arrangement to each other. The microphone matching unit comprises a measuring section arranged and configured to receive a first microphone response of the first microphone and a second microphone response of the second microphone, wherein the first and second microphone responses are transfer functions describing a conversion of a respective input sound signal into a respective electrical microphone output signal by means of the first and second microphone, and to measure a microphone response difference between the first microphone response and the second microphone response;

a calculation section arranged and configured to determine a matching difference between the microphone response difference and a predetermined reference microphone response difference; and an adaptation section, which is at least connected to the first microphone, and which is configured to adapt at least a first microphone gain of the first microphone according to the matching difference to reduce the matching difference between the microphone response difference and the predetermined reference microphone response difference.

The microphone matching unit according to the second aspect of the invention can advantageously improve a matching between the first microphone and second microphone by reducing the matching difference between the microphone response difference and the predetermined reference microphone response difference.

Furthermore, the microphone matching unit can be advantageously provided in small dimensions, since just appropriate connections and an appropriate circuit are required.

In a preferred embodiment according to the second aspect of the invention, the microphone matching unit further comprises a triggering section, which is connected to the receiver, and which is arranged and configured to compare the matching difference (cf. 'Error' in FIG. 7) with a predetermined difference threshold (cf. 'th' in FIG. 7) and to trigger an output sound signal of the receiver, if the predetermined difference threshold is smaller than the matching difference. The microphone matching unit of this embodiment further improves the matching of the microphones by adapting at least the first microphone at subsequent times until the matching difference is smaller than or equal to the predetermined difference threshold. Furthermore, the predetermined difference threshold has the further advantage that a matching quality of the microphones functionally coupled to the microphone matching unit can be predetermined and thus unified between hearing aids of the same type, from the same user or from the same manufacturer. In a variant of this embodiment, the triggering section is further configured to trigger an adaptation of the first microphone gain by the adaptation section only if the predetermined difference threshold is smaller than the matching difference.

In an embodiment according to the second aspect of the invention the microphone matching unit is arranged within an encasement of the hearing aid. In a variant of this embodiment, the microphone matching unit is electrically connected to the first and second microphone and to the receiver. A microphone matching unit according to this variant of the embodiment is directly connected to all parts of the hearing aid that are relevant for the microphone matching. Therefore, the microphone matching unit is robust and simple to manufacture. Arranging the microphone matching unit in the encasement has the further advantage that there is just one object which the user has to use for the microphone matching, and the microphone matching unit can also not be lost, as it is the case with a separate microphone matching unit.

In another embodiment, the microphone matching unit is arranged within (e.g. at a fixed position within) an external device (e.g. a storage box) that is separated from the hearing aid and which is configured to be connected to the hearing aid by an air interface. In this embodiment the external device can be advantageously user-friendly. A hearing aid should have as few buttons as possible, but the external device can provide clear and simple input means. In a variant of this embodiment, the external device is a box, which is additionally arranged to provide a predetermined spatial arrangement between the first and second microphone and the receiver. This embodiment enables a simple exchange of the microphone matching unit by simply exchanging the external device. In a variant, the air interface is formed by a standardized communication link (e.g. a Bluetooth (or Bluetooth Low Energy) connection, an NFC connection (NFC=Near Field Communication), by a ZigBee connection, or by a WLAN connection) or by a proprietary communication link (e.g. near-field (such as an inductive) link or a link based on far-field communication, e.g. in an ISM frequency range, e.g. in the 2.4 GHz range).

In a further embodiment, the microphone matching unit comprises a memory section, which is connected to the calculation section and configured to provide the calculation section with the predetermined reference microphone response difference. In a variant of this embodiment, the memory unit is further connected to the triggering section and configured to provide the triggering section with the predetermined difference threshold. The microphone matching unit of this embodiment provides a common section for storing data. Thus, a structure is provided that enables a direct access to the stored data of the microphone matching unit. This is particularly advantageous if a user input interface is arranged and configured to provide the microphone matching unit with a user input indicative of a predetermined difference threshold or of a predetermined reference microphone response difference.

According to a third aspect, the invention relates to a hearing aid. The hearing aid comprises a first and a second microphone, a receiver, and a microphone matching unit according to the second aspect of the invention.

In a preferred embodiment according to the third aspect of the invention, the first microphone is arranged within a BTE part of the hearing aid, and the second microphone and the receiver are arranged within an ITE part of the hearing aid. A hearing aid with a receiver within the ITE part of the hearing aid is also known as a receiver-in-the-ear (RITE) type hearing aid. The hearing aid of this embodiment is particularly advantageous because the second microphone in the ITE-part is located in the ear channel of the user to take advantage of a help in reception that is provided from the outer ear, i.e. from the Pinna. Thus, the arrangement of this embodiment is particularly advantageous for directional hearing aids (e.g. hearing aids comprising a directional system, allowing the hearing aid to enter a directional mode, where the first and second microphones are coupled to provide a spatially directional characteristic) and therefore also for an improved microphone matching of a directional hearing aid. Since the distance between the first and second microphones located within the BTE- and ITE-parts, respectively, differ from user to user (end even ear to ear) due to differences in head and ear/ear canal form and size, a proper matching of the microphones (including the measurement of a reference microphone response difference) cannot be made during manufacturing, but must be made after the hearing aid has been adapted (fitted) to an ear of a particular person, e.g. during a fitting procedure. More importantly, however, is the fact that the ITE part may be replaced as the lifespan of the ITE part is expected to be shorter than the BTE part. The matching purpose is that we need to estimate the changed magnitude difference between the ITE part and the BTE part in the case where the ITE part has been replaced.

In an embodiment, the hearing aid comprises a probe signal generator for providing the output sound signal as a specific probe signal. In an embodiment, the probe signal generator is configured to provide the probe signal as a predefined combination of tones, as for instance pure tones or a predefined sequence of tones at predefined frequencies. In an embodiment, the predefined frequencies are chosen with a view to the frequency range where feedback is expected to occur, for instance above 500 Hz, or above 1 kHz or above 1.2 kHz. In an embodiment, the hearing aid is configured to play the probe signal alone. In an embodiment, the hearing aid is configured to play the probe signal as a mixture with a signal derived from the first and/or second microphones. In an embodiment, the hearing aid is configured to activate the probe signal generator in a predefined mode of operation (e.g. for a predefined, limited time period, e.g. less than 10 s), e.g. via a user interface.

According to a fourth aspect, the invention relates to a microphone matching arrangement. The microphone matching arrangement comprises a hearing aid, a microphone matching unit according to the second aspect of the invention, and a box forming a predetermined measuring environment for the hearing aid during a measuring and processing of the microphone matching unit, e.g. a storage box of the hearing aid or a pair of hearing aids.

This aspect has the further advantage, that the box can be advantageously user-friendly. The box according to the fourth aspect of the invention is arranged to provide a predetermined spatial arrangement between the first and second microphone and the receiver. This improves the reliability of the microphone matching, and especially the applicability of the predetermined reference microphone response difference.

In an embodiment, the microphone matching unit is arranged within the hearing aid, while the predetermined reference microphone response difference, which is stored in the hearing aid, is adapted at the predetermined acoustical conditions provided by the box.

In another embodiment of the microphone matching arrangement, the microphone matching unit is arranged in the box. The microphone matching arrangement of this embodiment enables a simple exchange of the microphone matching unit by simply exchanging the box. In general, a hearing aid should have as few buttons as possible, but the box can provide clear and simple input means for performing the microphone matching.

In an embodiment of the fourth aspect, an air interface between the box and the hearing aid is provided, while the microphone matching unit is arranged within the box. In a variant of this embodiment, the air interface is formed by a Bluetooth connection, by a NFC connection, by a ZigBee connection, or by a WLAN connection.

In a further embodiment of the microphone matching arrangement, the microphone matching unit is arranged within the box, and the box provides an electrical (e.g. wireless) connection between microphone matching unit and hearing aid, while the hearing aid is arranged in the predetermined spatial arrangement. In this embodiment, the hearing aid provides a matching connection, which is in electrical connected to a box connection during the microphone matching and thus provides a direct connection to the microphone matching unit.

In a preferred embodiment of the microphone matching arrangement, the box provides a recess for arranging the hearing aid in the predetermined spatial arrangement. The arrangement of this embodiment allows a particularly precise arranging of the hearing aid in the predetermined spatial arrangement. Therefore, the microphone matching can be particularly precise in view of a precise rearranging of the hearing aid.

In an embodiment, the hearing aid and/or the box (for performing microphone measurement) comprises a temperature sensor for estimating a current temperature of the environment around the hearing aid (e.g. during measurement). In an embodiment, the method or microphone matching unit or hearing aid is configured compensate for possible differences in environment temperature between the measurement of predetermined reference microphone response difference and the current microphone response difference. In an embodiment, a number of different predetermined reference microphone response differences at different temperatures are available (e.g. stored in a memory) for comparison with the currently measured microphone response difference.

According to a fifth aspect, the invention relates to a computer program for controlling a hearing aid comprising program code means for causing a processor to carry out a method according to the first aspect of the invention.

The computer, which comprises the computer program may for instance form an integral part of the hearing aid and can be implemented as a microcontroller or microprocessor. In another embodiment, the computer forms an integral part of the box.

The above and other aspects, features and advantages of the present invention will be more apparent from the following more particular description thereof, presented in conjunction with the following drawings wherein.

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
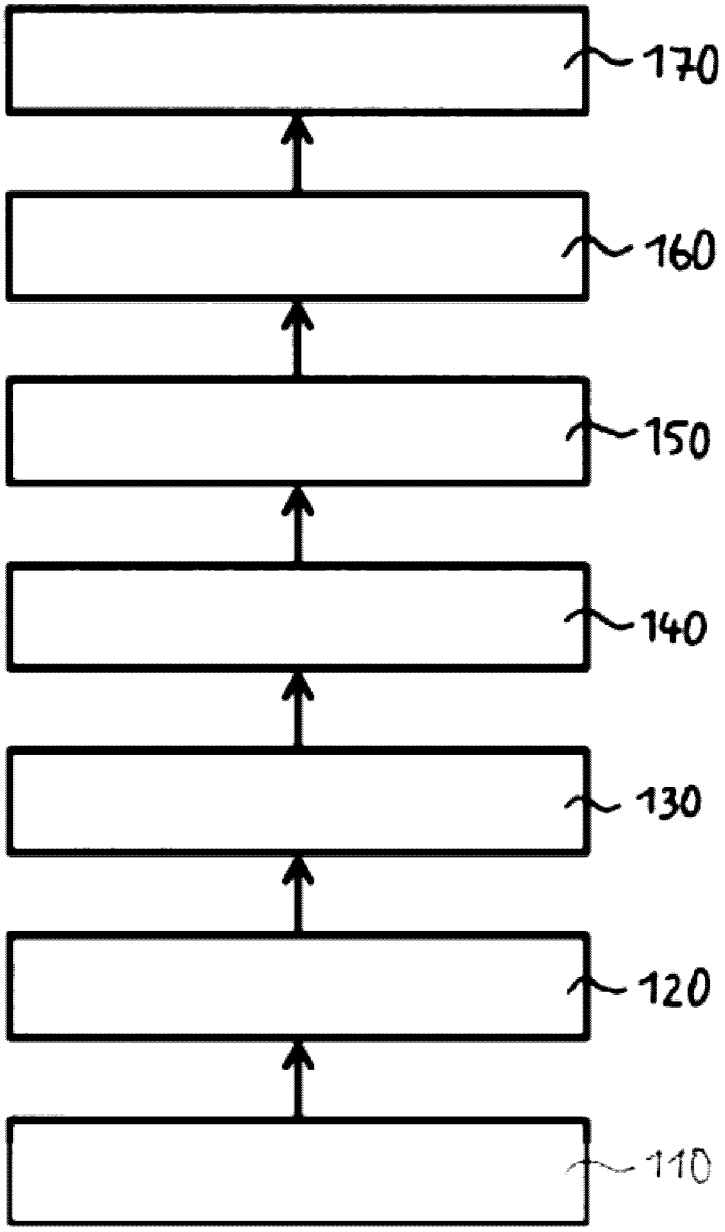
FIG. 1 is an illustration of an embodiment of the method for performing a microphone matching of a hearing aid according to a first aspect of the invention.

FIG. 1 is an illustration of an embodiment of the method for performing a microphone matching of a hearing aid according to a first aspect of the invention. For performing this method, a hearing aid is provided that comprises a first microphone, a second microphone and a receiver in a predetermined spatial arrangement to each other. The method comprises seven steps.

A first step (110) comprises a generating of an output sound signal by means of the receiver.

Afterwards the method comprises a picking up (120) of a first input sound signal by the first microphone and of a second input sound signal by the second microphone while the output sound signal is generated.

A further step (130) comprises a converting of the first input sound signal into a first electrical microphone output signal by means of the first microphone and of the second input sound signal into a second electrical microphone output signal by means of the second microphone. The steps of picking up of sound and converting sound to an electric signal is e.g. provided by an input transducer, such as a microphone.

The next two subsequent steps (140, 150) of the method according to the first aspect of the invention comprise a determination (140) of a first microphone response of the first microphone, and of a second microphone response of the second microphone, and afterwards a determination (150) of a microphone response difference between the first microphone response and the second microphone response.

A determination of a matching difference between the microphone response difference and a predetermined reference microphone response difference forms the next step (160) of this method. The reference microphone response difference may be determined in a prior step (and/or stored in a memory or downloaded from a database or otherwise be made available).

As a final step (170), the method according to the illustrated embodiments comprises an adaptation of at least a first microphone gain of the first microphone according to the matching difference to reduce the matching difference between the microphone response difference and the predetermined reference microphone response difference.

The method shown in FIG. 1 improves a matching between the first and second microphone. Such a matching improves a directionality of the output sound signal of the hearing aid, since due to variations in production and over time, the first and second microphones will not be fully matched. Especially in hearing instruments that contain a first microphone in a behind-the-ear (BTE) part and the second microphone in an in-the-ear (ITE) part, it is not possible to match the microphones during production, as both BTE and ITE parts may be replaced (or relocated) later on (e.g. due to the different fitting of BTE- and ITE-parts relative to each other due to different forms and dimensions of ears of different persons).

In an embodiment not shown, the method according to the first aspect of the invention further comprises an iterative query comprising two subsequent steps. The first step is formed by a comparing of the matching difference with a predetermined difference threshold, and the second step comprises a repeating of the method for performing a microphone matching according to the embodiment shown in FIG. 1 as long as the predetermined difference threshold is smaller than the respective matching difference.

Figure 2:
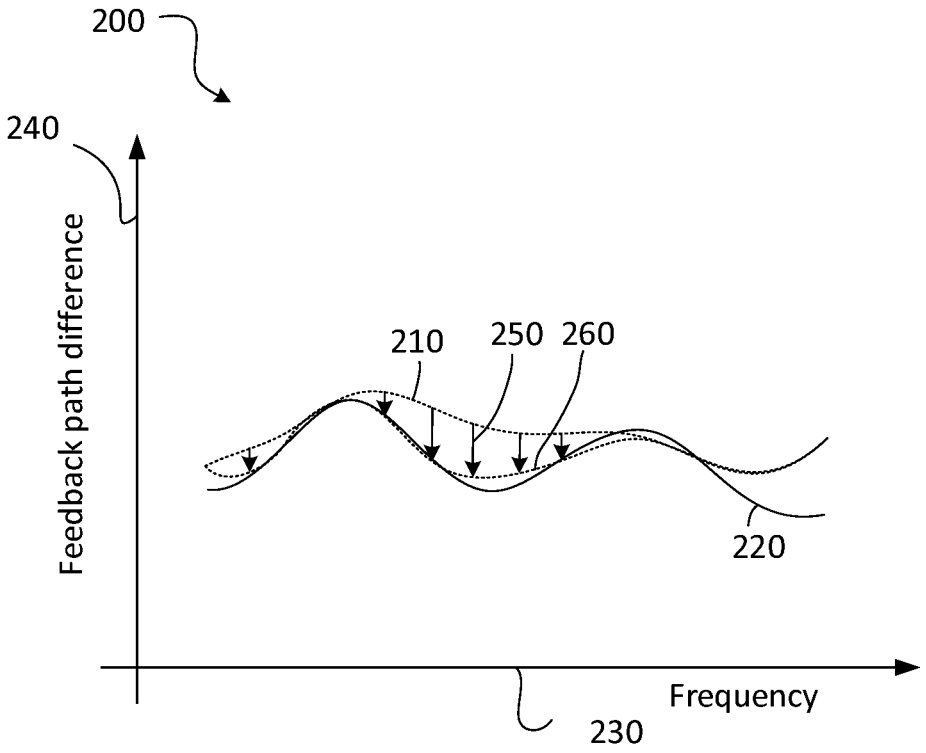
FIG. 2 shows a diagram visualizing an adaptation of at least a first microphone gain with respect to an embodiment according to the first aspect of the invention.

FIG. 2 shows a diagram 200 visualizing an adaptation of at least a first microphone gain with respect to an embodiment according to the first aspect of the invention.

The diagram 200 shows the determined microphone response difference 210 and the predetermined reference microphone response difference 220, both studied over frequency on the x-axis 230. The y-axis 240 has the dimension of a feedback path difference (e.g. in dB), which is determined in dependence of the determined different first and second frequency responses of the microphones.

The arrows 250 show the matching difference before performing the method and illustrate how the microphone response difference 210 is improved by a single adaptation step of adapting the first microphone gain of the first microphone. As illustrated in FIG. 2, an improved microphone response difference 260 is reached, which shows considerably smaller deviations from the predetermined reference microphone response difference 220. Thus, diagram 200 shows that the matching difference between the first and second microphones is improved by the method according to the first aspect of the invention. The first microphone gain and thus the microphone response difference 210 are e.g. improved by using an LMS or NLMS algorithm according to the determined matching difference.

In an embodiment not shown, the first and second microphone responses comprise an impulse response, an amplitude response, or a phase response of the respective microphone. Corresponding diagrams as in FIG. 2 therefore show the matching differences over impulse, amplitude or phase on the x-axis.

Figure 3:
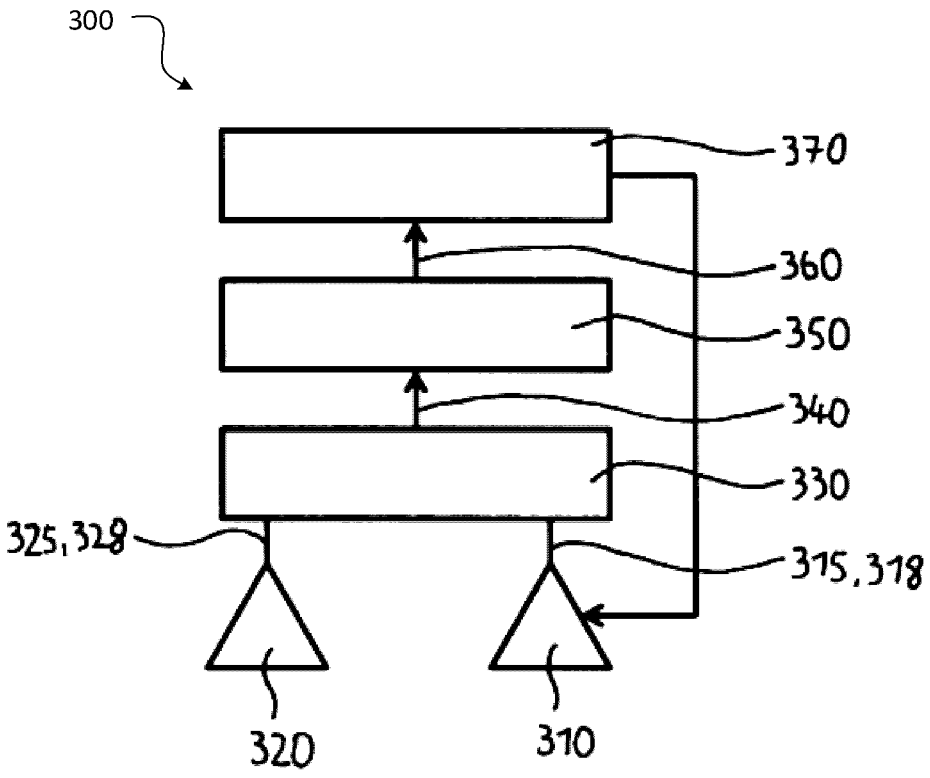
FIG. 3 is a schematic illustration of a first embodiment of a microphone matching unit according to a second aspect of the invention.

FIG. 3 is a schematic illustration of a first embodiment of a microphone matching unit 300 according to a second aspect of the invention. The microphone matching unit 300 is arranged and configured to perform a microphone matching of a hearing aid. The hearing aid comprises a first microphone 310, a second microphone 320 and a receiver in a predetermined spatial arrangement to each other.

The microphone matching unit 300 comprises a measuring section 330 arranged and configured to receive a first microphone response 315 of the first microphone 310 and a second microphone response 325 of the second microphone 320, wherein the first and second microphone responses are transfer functions describing a conversion of a respective input sound signal into a respective electrical microphone output signal 318, 328 by means of the first and second microphone 310, 320, and to measure a microphone response difference 340 between the first microphone response 315 and the second microphone response 315. The microphone response difference 340 is received by a calculation section 350, which is arranged and configured to determine a matching difference 360 between the microphone response difference 340 and a predetermined reference microphone response difference. After determining the matching difference 360, an adaptation section 370, which is at least connected to the first microphone 310, receives the matching difference 360 and adapts a first microphone gain of the first microphone 310 (or a second gain of the second microphone 320, or both) according to the matching difference 360 to reduce the matching difference 360 between the microphone response difference 340 and the predetermined reference microphone response difference.

As shown in FIG. 3, the microphone matching unit 300 according to the shown first embodiment is electrically connected to the first and second microphone 310, 320. Furthermore the microphone matching unit 300 of the shown first embodiment is configured to be arranged within an encasement of the hearing aid.

In an embodiment not shown, the measuring section 330, the calculation section 350 and the adaptation section 370 are integrated into another section of the hearing aid and therefore at least partly spatially separated.

Figure 4A:
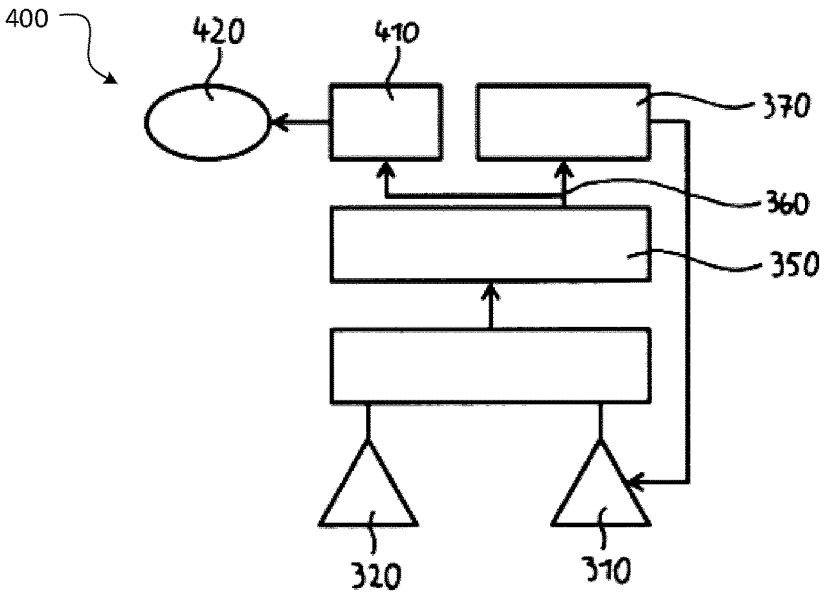
FIG. 4A is a schematic illustration of a second embodiment of the microphone matching unit according to the second aspect of the invention.

FIG. 4*a* is a schematic illustration of a second embodiment of the microphone matching unit 400 according to the second aspect of the invention. The second embodiment of the microphone matching unit 400 is similar to the first embodiment shown in FIG. 3.

In contrast to the microphone matching unit 300 shown in FIG. 3, the microphone matching unit 400 further comprises a triggering section 410, which is connected to the receiver (loudspeaker) 420 and to the calculation section 350, and which is arranged and configured to compare the matching difference 360 with a predetermined difference threshold and to trigger an output sound signal of the receiver 420 if the predetermined difference threshold is smaller than the matching difference. If there is no output sound signal of the receiver 420 triggered, the adaption unit 370 has adapted the first microphone gain and the microphone matching is stopped.

The microphone matching unit 400 improves the matching of the microphones 310, 320 by adapting at least the first microphone 310 at subsequent times until the matching difference 360 is smaller or equal to the predetermined difference threshold. Furthermore, the predetermined difference threshold has the further advantage that a matching quality of the microphones 310, 320 electrically coupled to the microphone matching unit 400 can be predetermined and thus unified between hearing aids of the same type, from the same user or from the same manufacturer.

Figure 4B:
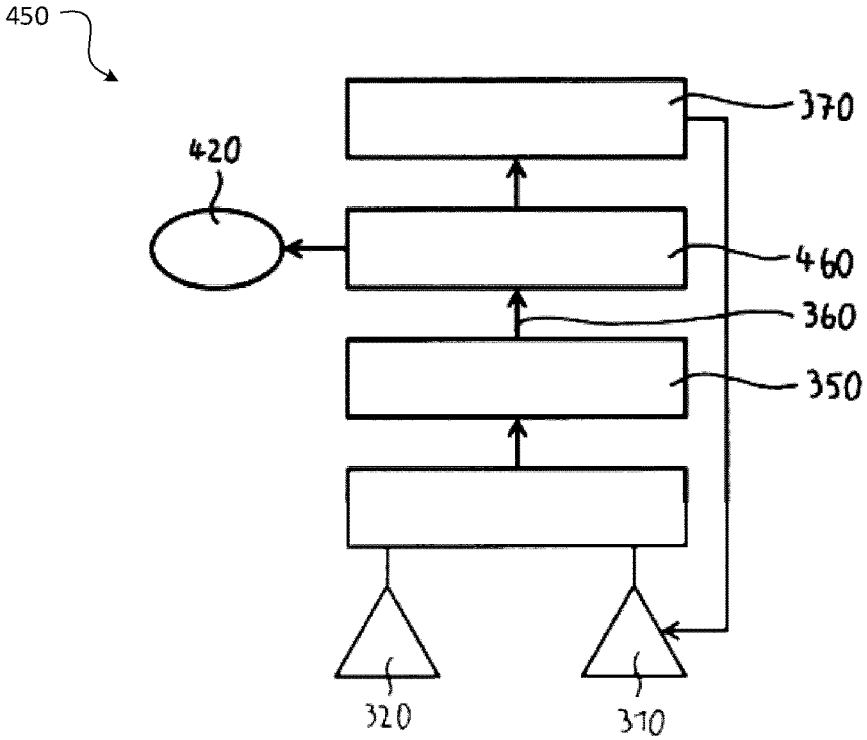
FIG. 4B is a schematic illustration of a third embodiment of the microphone matching unit according to the second aspect of the invention.

FIG. 4*b* is a schematic illustration of a third embodiment of the microphone matching unit 450 according to the second aspect of the invention. The third embodiment of the microphone matching unit 450 is similar to the second embodiment shown in FIG. 4*a*.

In contrast to the microphone matching unit 400 of the second embodiment, the microphone matching unit 450 comprises a triggering section 460 that is arranged between the calculation section 350 and the adaptation section 370. Furthermore, compared to the triggering section 410, the triggering section 460 is further configured to trigger an adaptation of the at least first microphone gain by the adaptation section 370 only if the predetermined difference threshold is smaller than the matching difference 360. Thus, if the matching difference 360 is smaller or equal to the predetermined difference threshold, the adaptation section 370 will not adapt the first microphone gain and the microphone matching stops.

In a further embodiment not shown, the microphone matching unit further comprises a memory section, which is connected to the calculation section and to the triggering section, and configured to provide the calculation section with the predetermined reference microphone response difference, and to provide the triggering section with the predetermined difference threshold.

Figure 5:
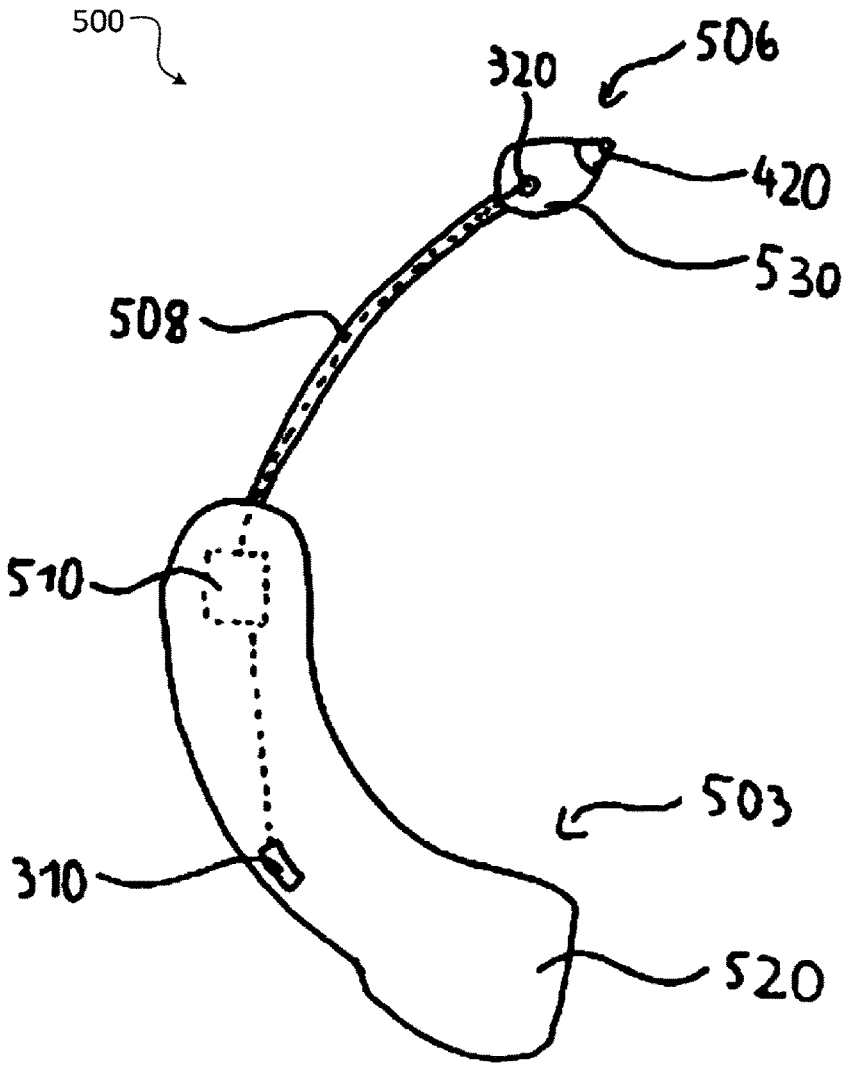
FIG. 5 is an illustration of an embodiment of the hearing aid according to a third aspect of the invention.

FIG. 5 is an illustration of an embodiment of the hearing aid 500 according to a third aspect of the invention.

The hearing aid 500 comprises the first and the second microphone 310, 320, the receiver 420 and a microphone matching unit 510 according to the second aspect of the invention.

As shown in FIG. 5, the hearing aid comprises a BTE part 503 and an ITE part 506. The BTE part 503 provides a first encasement 520 for the microphone matching unit 510 and for the first microphone 310, and is physically connected to the ITE part 506 via a connection element 508. The ITE part 506 provides a second encasement 530 for the second microphone 320 and for the receiver 420.

The ITE part may be replaced by another ITE part due to several reasons: 1) Change of the ITE receiver wire length die to a different ear size; 2) Change of ITE receiver in order to cover a different fitting range; 3) Change of ITE part due to malfunction of either the receiver or the microphone. Typically, the lifespan of the ITE part is smaller than the lifespan of the BTE part.

The connection element 508 provides an electrical connection between the second microphone 320 and the microphone matching unit 510, and between the receiver 420 and the microphone matching unit 510. Since two microphones 310, 320 are used within the hearing aid 500, it is apparent that this is a so-called directional hearing aid (allowing a directional mode of operation to be established), providing the user with a directional output sound signal by means of the receiver.

Parts of the hearing aid 500 that are not related to the microphone matching, are not shown in FIG. 5.

The hearing aid 500 of this embodiment is particularly advantageous because the second microphone 320 in the ITE-part 506 is located in the ear channel of the user to take advantage of a help in reception that is provided from the outer ear, i.e. from the Pinna. Thus, the hearing aid 500 of this embodiment is particularly advantageous for an improved microphone. The increased distance between the first and second microphones (compared to other solutions where the two microphones are located close together on the BTE-part) is further an advantage when creating a directional signal from the two microphone signals (at relatively low frequencies).

Figure 6:
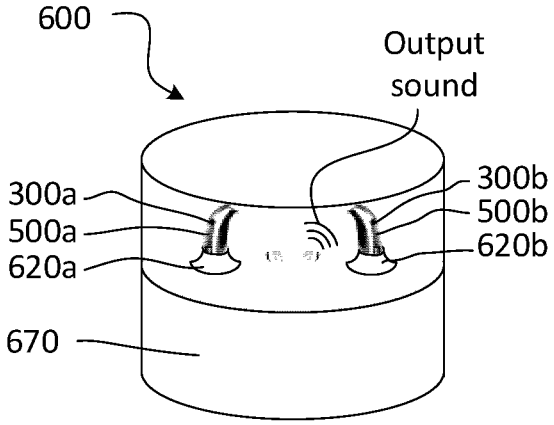
FIG. 6 is an illustration of an embodiment of a microphone matching arrangement according to the fourth aspect of the invention.

FIG. 6 is an illustration of an embodiment of a microphone matching arrangement 600 according to the fourth aspect of the invention.

The microphone matching arrangement 600 comprises two hearing aids 500*a*, 500*b*, a respective microphone matching unit 300*a*, 300*b* according to the second aspect of the invention, and a box 610 forming a predetermined measuring environment for the hearing aids 500*a*, 500*b* during a measuring and processing of the microphone matching unit 300*a*, 300*b*. Preferably, the measuring (and subsequent processing) of a microphone response difference between the first and second microphones is performed for one hearing aid at a time (to not disturb a corresponding measurement in the other hearing aid), e.g. sequentially (as also indicated by the sound emitted by only the right hearing aid 500*b* (cf. three curved lines denoted Output sound in FIG. 6) in the box.

The microphone matching units 300*a*, 300*b* are arranged within the hearings aids 500*a*, 500*b* and configured to perform a method according to the first aspect of the invention.

The box 610 of the microphone matching arrangement further provides a first and a second recess 620*a*, 620*b* for respectively arranging the hearing aids 500*a*, 500*b* in the predetermined spatial arrangement. The cylindrical structure of the box 610 and the symmetric positions of the first and second recess with respect to the centre axis of the cylindrical structure, lead to a particularly precise microphone matching. Both hearing aids 500*a*, 500*b* have the same predetermined reference microphone response difference, since both have the same acoustical environment within the box 610.

In an embodiment not shown, an air interface between the box and the hearing aids is provided, while the microphone matching unit is arranged within the box. In a variant of this embodiment, the air interface is formed by a Bluetooth connection, by a NFC connection, by a ZigBee connection, or by a WLAN connection.

In a further embodiment not shown, the microphone matching unit is arranged within the box, and the box provides electrical connections between microphone matching unit and hearing aids, while the hearing aids are arranged in the predetermined spatial arrangement.

In an embodiment, the box is a storage box for storing the hearing aids when not in use. In an embodiment, the box is a charging box for charging rechargeable batteries of the hearing aids.

In an embodiment, the method comprises determining cross transfer functions between a loudspeaker of the first hearing aid 500*a* and first and second microphones of the second hearing aid 500*b*, by playing a probes sound signal in the loudspeaker and receiving the probe signal by each of the microphones. Likewise, cross transfer functions between a loudspeaker of the second hearing aid 500*b* and first and second microphones of the first hearing aid 500*a* can be performed (at another point in time). The resulting (four) transfer functions may be compared and used to diagnose any malfunctions in the 4 different acoustic channels (comprising 2 loudspeakers and 4 microphones).

Figure 7:
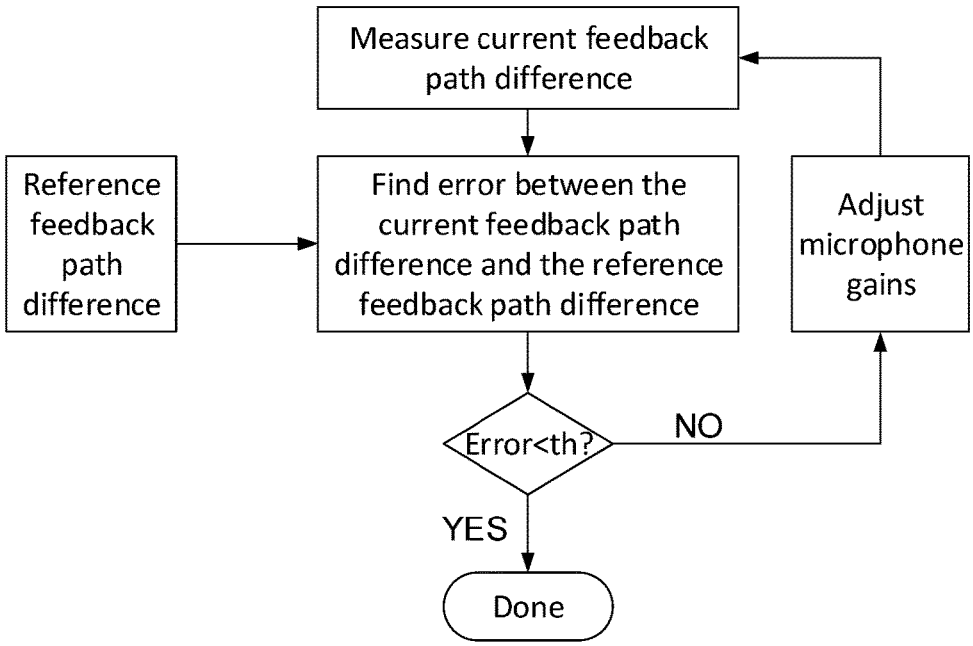
FIG. 7. Illustrates an embodiment of the proposed method using a feedback path difference measurement to guide the microphone matching.

FIG. 7. illustrates an embodiment of the proposed method using a feedback path difference measurement to guide the microphone matching. The method comprises the steps of a) Measure current feedback path difference between the first and second microphones (e.g. by applying a predefined test sound signal to the receiver of the hearing aid).

b) Provide a reference feedback path difference (e.g. measured or estimated during a fitting procedure). Provide a threshold th value representing an acceptable difference between a current and a reference feedback difference (the threshold value may be time dependent (e.g. dependent of the time elapsed since the last microphone matching procedure) and/or frequency dependent, e.g. different in different frequency bands).

c) Find error (difference) between the current feedback path difference and the reference feedback path difference.

d) Error<th? (determined whether the error is smaller than the acceptable threshold value th).

e) If no, adjust the microphone gains and repeat steps a), c), d).

f) If yes, the microphone matching is successfully ended ('Done').

In an embodiment, the error or difference between the current feedback path difference and the reference feedback path difference is determined as a statistical difference measure, e.g. a statistical distance norm, such as a Euclidean distance.

In the exemplary flow diagram of FIG. 7 only amplitude matching is considered. However, phase matching might alternatively or additionally be obtained by other methods, such as convex optimization.

Although exemplary embodiments of the present invention have been shown and described, it should be apparent to those of ordinary skill that a number of changes and modifications to the invention may be made without departing from the spirit and scope of the invention. In particular, it is possible to use the method for performing a microphone matching for all kinds of hearing systems that comprise two microphones and a receiver. This invention can be readily adapted to a number of different kinds of microphone matching units, of hearing aid designs and also of different kinds of microphone adaptation schemes by following the present teachings. All such changes, modifications and alterations should therefore be recognized as falling within the scope of the present invention.

What is claimed is:

1. A method for performing a microphone matching of a hearing aid comprising a first microphone, a second microphone and a receiver in a predetermined spatial arrangement relative to each other, the method comprising the steps generating an output sound signal by means of the receiver;

picking up a first input sound signal by the first microphone and a second input sound signal by the second microphone while the output sound signal is generated;

converting the first input sound signal into a first electrical microphone output signal by means of the first microphone and the second input sound signal into a second electrical microphone output signal by means of the second microphone;

determining a first microphone response of the first microphone, and a second microphone response of the second microphone at a given point in time;

determining a microphone response difference between the first microphone response and the second microphone response;

determining a matching difference between the microphone response difference and a predetermined reference microphone response difference; and adapting at least a first microphone gain of the first microphone according to the matching difference to reduce the matching difference between the microphone response difference and the predetermined reference microphone response difference, wherein the first microphone response is determined from a first estimate of a first feedback path from the receiver to the first microphone and wherein the second microphone response is determined from a second estimate of a second feedback path from the receiver to the second microphone.

2. The method according to claim 1, further comprising the steps comparing the matching difference with a predetermined difference threshold;

repeating the method for performing a microphone matching according to claim 1 as long as the predetermined difference threshold is smaller than the respective matching difference.

3. The method according to claim 1, wherein the first and second microphone responses comprise an impulse response, a frequency response, an amplitude response, or a phase response of the respective microphone.

4. The method according to claim 1, wherein the first microphone response is determined from the first electrical microphone output signal and the second microphone response is determined from the second electrical microphone output signal.

5. The method according to claim 1, wherein the adaptation of at least the first microphone gain comprises an LMS or NLMS algorithm that is used according to the matching difference to reduce the matching difference between the microphone response difference and the predetermined reference microphone response difference.

6. The method according to claim 1, further comprising as a first step providing a predetermined measuring environment for the hearing aid according to the predetermined reference microphone response difference, wherein the first microphone, the second microphone and the receiver are located in said predetermined spatial arrangement relative to each other.

7. The method according to claim 1, further comprising as first steps providing a group of predetermined reference microphone response differences that corresponds to a group of predetermined measuring environments;

receiving a user input indicative of a chosen predetermined measuring environment that is chosen out of the group of predetermined measuring environments;

using a respective predetermined reference microphone response difference out of the group of predetermined reference microphone response differences according to the chosen predetermined measuring environment.

8. A method according to claim 1 comprising compensating for possible differences in environment temperature between the measurement of a predetermined reference microphone response difference and a current microphone response difference.

9. A microphone matching unit for performing a microphone matching of a hearing aid, the hearing aid comprises a first microphone, a second microphone and a receiver in a predetermined spatial arrangement to each other, the microphone matching unit comprising a measuring section arranged and configured to receive a first microphone response of the first microphone and a second microphone response of the second microphone, wherein the first and second microphone responses are transfer functions describing a converting of a respective input sound signal into a respective electrical microphone output signal by means of the first and second microphone, and to measure a microphone response difference between the first microphone response and the second microphone response;

a calculation section arranged and configured to determine a matching difference between the microphone response difference and a predetermined reference microphone response difference; and an adaptation section, which is at least connected to the first microphone, and which is configured to adapt at least a first microphone gain of the first microphone according to the matching difference to reduce the matching difference between the microphone response difference and the predetermined reference microphone response difference, wherein the first microphone response is determined from a first estimate of a first feedback path from the receiver to the first microphone and wherein the second microphone response is determined from a second estimate of a second feedback path from the receiver to the second microphone.

10. The microphone matching unit according to claim 9, further comprising a triggering section, which is connected to the receiver, and which is arranged and configured to compare the matching difference with a predetermined difference threshold and to trigger an output sound signal of the receiver if the predetermined difference threshold is smaller than the matching difference.

11. The microphone matching unit according claim 9, wherein the microphone matching unit is arranged within an encasement of the hearing aid.

12. The microphone matching unit according to claim 9, wherein the microphone matching unit is arranged within an external device that is separated from the hearing aid and which is configured to be connected to the hearing aid by an air interface.

13. A hearing aid, comprising a first and a second microphone;

a receiver; and a microphone matching unit according to claim 9.

14. The hearing aid according to claim 13 comprising a probe signal generator for providing the output sound signal as a specific probe signal.

15. The hearing aid according to claim 14, wherein the probe signal generator is configured to provide the probe signal as a predefined combination of pure tones or a predefined sequence of tones at predefined frequencies.

16. The hearing aid according to claim 14 comprising a user interface, and wherein the hearing aid is configured to activate the probe signal generator in a predefined microphone matching mode of operation via the user interface.

17. The hearing aid according to claim 13, wherein the first microphone is arranged within a BTE part of the hearing aid, and the second microphone and the receiver are arranged within a replaceable ITE part of the hearing aid.

18. A microphone matching arrangement, comprising a hearing aid;

a microphone matching unit according to claim 9; and a box forming a predetermined measuring environment for the hearing aid during a measuring and processing of the microphone matching unit.

19. A non-transitory computer readable medium having stored thereon a computer program for controlling a hearing aid comprising program code for causing a processor to carry out a method according to claim 1.

20. The method of claim 1, wherein the first and second feedback paths are estimated based on a probe signal received from the receiver.

* * * * *